US009382805B2

(12) United States Patent
Shaw

(10) Patent No.: US 9,382,805 B2
(45) Date of Patent: Jul. 5, 2016

(54) BALANCING OF ROTORS

(71) Applicant: ROLLS-ROYCE PLC, London (GB)

(72) Inventor: Alexander Lewis Shaw, Derby (GB)

(73) Assignee: ROLLS-ROYCE plc, London (GB)

( * ) Notice: Subject to any disclaimer, the term of this patent is extended or adjusted under 35 U.S.C. 154(b) by 716 days.

(21) Appl. No.: 13/751,810

(22) Filed: Jan. 28, 2013

(65) Prior Publication Data

US 2013/0224029 A1 Aug. 29, 2013

(30) Foreign Application Priority Data

Feb. 27, 2012 (GB) ..... 1203303.1

(51) Int. Cl.

| | |
|---|---|
| ***F01D 5/30*** | (2006.01) |
| ***F04D 29/32*** | (2006.01) |
| ***F01D 5/02*** | (2006.01) |
| ***F04D 29/66*** | (2006.01) |

(52) U.S. Cl.

CPC *F01D 5/30* (2013.01); *F01D 5/027* (2013.01); *F01D 5/303* (2013.01); *F04D 29/321* (2013.01); *F04D 29/662* (2013.01); *Y10T 29/49316* (2015.01)

(58) Field of Classification Search

CPC ..... F01D 5/30; F01D 5/027; F01D 5/303; F01D 5/10; F01D 5/26; F04D 29/321; F04D 29/662

See application file for complete search history.

(56) References Cited

U.S. PATENT DOCUMENTS

| | | | | |
|---|---|---|---|---|
| 3,736,811 | A | 6/1973 | Neary | |
| 6,279,420 | B1 * | 8/2001 | Knorowski | B25B 13/48 409/141 |
| 6,477,916 | B2 | 11/2002 | Knorowski et al. | |
| 6,769,877 | B2 * | 8/2004 | Martin | F01D 5/147 29/889.21 |
| 7,753,651 | B2 * | 7/2010 | Dezouche | F01D 5/027 416/145 |
| 2001/0019697 | A1 | 9/2001 | Mueller et al. | |
| 2003/0143078 | A1 * | 7/2003 | Benedetto | F01D 5/303 416/219 R |
| 2005/0265846 | A1 | 12/2005 | Przytulski et al. | |
| 2010/0296937 | A1 | 11/2010 | Bestwick | |

FOREIGN PATENT DOCUMENTS

| | | |
|---|---|---|
| WO | WO 2005/101323 | 10/2005 |

OTHER PUBLICATIONS

Jun. 15, 2012 Search Report issued in British Patent Application No. GB1203303.1.

* cited by examiner

*Primary Examiner* — Richard Edgar
*Assistant Examiner* — Brian P Wolcott
(74) *Attorney, Agent, or Firm* — Oliff PLC

(57) ABSTRACT

A balanced rotor comprising a circumferential slot and a plurality of aerofoils each secured in the slot by a respective root, the root having a root block having circumferentially facing flanks and a seal wing extending circumferentially from one of the flanks, characterized in that the seal wing has a notch engaging a balance weight positioned between adjacent roots.

9 Claims, 6 Drawing Sheets

BALANCING OF ROTORS

TECHNICAL FIELD OF INVENTION

The present invention relates to rotors and in particular rotors for gas turbines and apparatus and methods for balancing a rotor.

BACKGROUND OF INVENTION

Gas turbine engines have rotors provided by discs or drums which rotate at many thousands of revolutions per minute. The discs or drums have axial or circumferential slots into which roots of aerofoils are mounted and secured. It is important that the rotor is balanced to avoid component life-limiting stresses and strains being generated.

Some of the methods proposed in the past to balance rotors have included special weights within the slot some of which are secured by fixings such as screws which ensure the position of the weighted components is unchanged in use and damage to adjacent components prevented. Many of these weights have the disadvantage that special tooling is required to secure the weight in its desired location and the further disadvantage that there is potential for the disc or drum to be damaged which may require the scrapping or reworking of components.

It is an object of the present invention to seek to address these and other problems.

STATEMENTS OF INVENTION

According to a first aspect of the invention there is provided a balanced rotor comprising a circumferential slot and a plurality of aerofoils each secured in the slot by a respective root, the root having a root block having circumferentially facing flanks and a seal wing extending circumferentially from one of the flanks, characterised in that the seal wing has a notch 22 engaging a balance weight positioned between adjacent roots.

The balance weight engages the slot such that circumferential movement is inhibited through contact with the seal wing or an adjacent seal wing. In use it is desirable that the balance weight does not contact the seal wing but instead loads against a flank of the root block.

Preferably the balance weight has a surface which abuts one of the circumferentially facing flanks of one of its adjacent roots and preferably the surface abuts the circumferentially facing flank of the root block from which the seal wing extends.

Radial loads from the balance weight are preferably transmitted directly to walls defining the slot. By directly it is meant that the radial loads are not transmitted through any other component, such as the root block or seal wing.

Preferably the seal wing has a circumferentially extending edge and a radially extending edge, the notch 22 extending into the seal wing from the circumferentially extending edge. The notch 22 may not extend from the radially extending edge though it is desirable for it to do so.

According to a second aspect of the invention there is provided a blade for use in a balanced rotor, the blade having an aerofoil and a root having a root block having angled flanks for engaging with a circumferential slot in a gas turbine disc or drum and opposing sides connecting the angled flanks, wherein a seal wing projects from at least one of the opposing sides and has a notch 22 for engaging a balance weight.

Preferably the seal wing has a bottom edge and a side edge and the notch 22 extends into the seal wing from the bottom edge. Preferably the notch also extends into the seal wing from the side edge.

According to a third aspect of the invention there is provided a method of assembling a rotor comprising the steps of providing a drum or disc having a circumferential slot, loading at least one blade according to any of the preceding two paragraphs into the slot, and inserting a weight into the slot, the weight engaging the notch.

DESCRIPTION OF DRAWINGS

The invention will now be described, by way of example only, and with reference to the accompanying drawings in which.

DETAILED DESCRIPTION OF INVENTION

Figure 1:
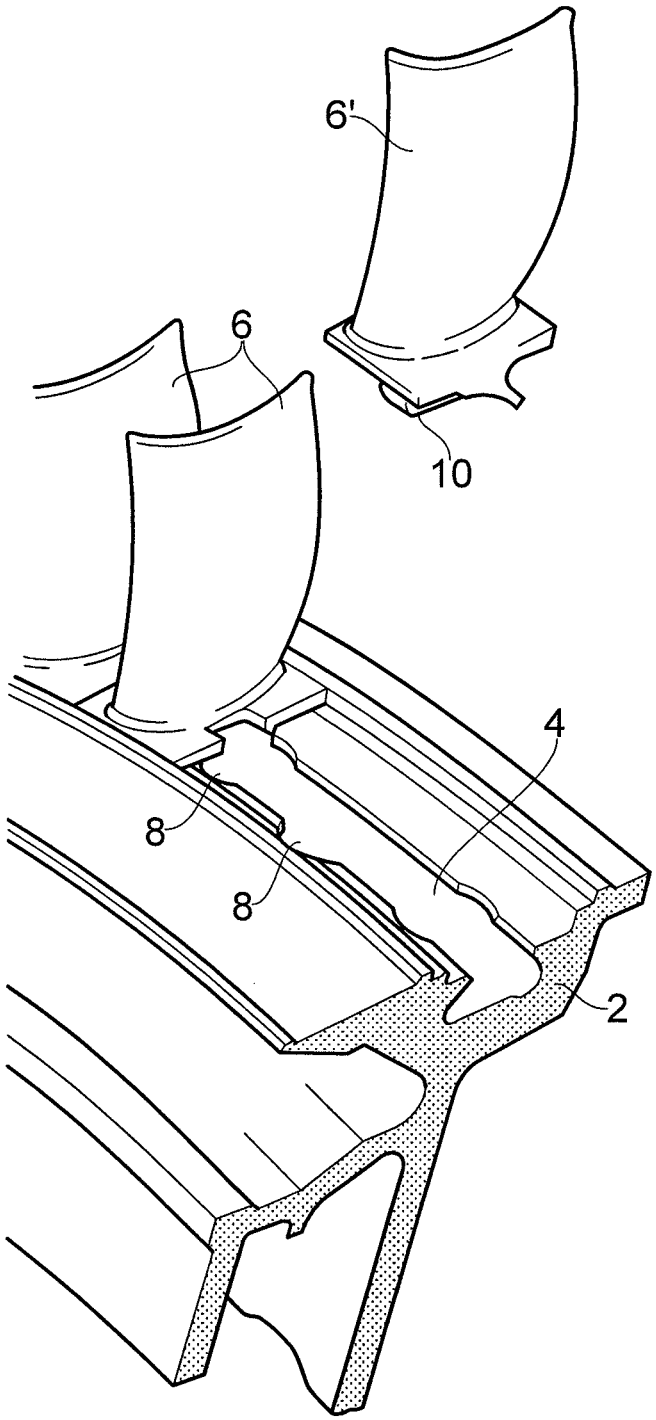
FIG. 1 depicts a typical rotor of a gas turbine having a circumferential slot for the mounting of aerofoils.

FIG. 1 depicts a gas turbine compressor rotor 2 having a circumferentially extending slot 4 into which two aerofoils 6 have been mounted and a third 6' is presented for mounting. The slot 4 has a plurality of loading apertures 8 which are sized to permit entry of the aerofoil root 10 into the slot. Once the root is mounted in the slot it may be slid along the slot till its desired location is reached.

In this specification the terms axial, radial and circumferential are used with respect to the engine as a whole, unless specifically stated otherwise.

Figure 2:
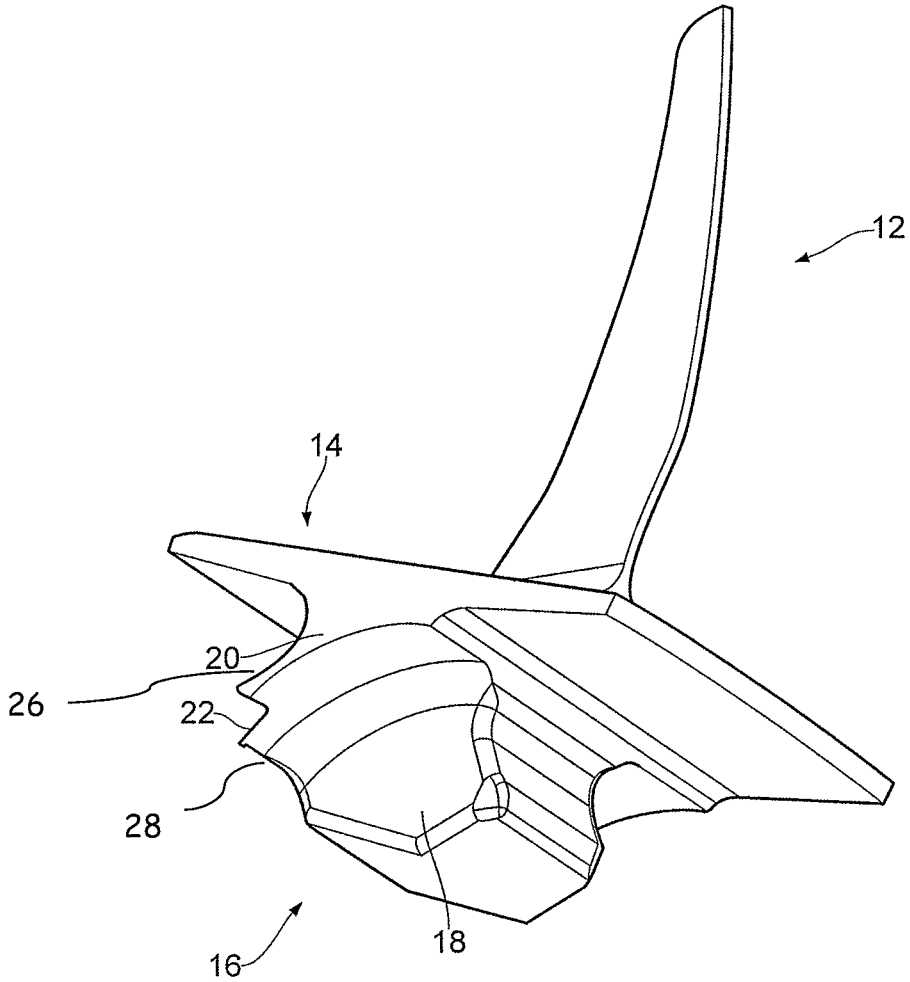
FIG. 2 depicts a typical aerofoil for mounting within the slot.

FIG. 2 depicts a typical compressor blade which has an aerofoil portion 12 a platform portion 14 and a root portion 16. The aerofoil portion 12 has a leading edge and a trailing edge and opposing flanks, which connect between the leading and trailing edges: a concave pressure surface and a convex suction surface.

The platform section 14 abuts the adjacent platform sections of neighbouring blades to provide a smooth, airwashed surface in use.

The root portion 16 depends from the platform section 14 on the opposing side to the aerofoil 12. The root has a root block 16 which provides the necessary contact faces to react against complementary surfaces in the disc slot 4 and laterally extending seal wings 20 (one is shown) on opposing sides of the root block.

The seal wings provide a blockage to prevent leakage of the higher pressure air flowing via the root cavity to a lower pressure zone upstream. The seal wings are provided with a stepped end (or cut-out) 22 the purpose of which will be described in more detail in due course. In FIG. 2, the stepped end 22 (also referred to as a notch 22 or cut-out 22) is provided at a corner of the seal wing 20 and extends into the seal wing from both a circumferentially extending edge 26 (also referred to as a bottom edge 26) of the seal wing and also from a radially extending edge 28 (also referred to as a side edge 28 or radial edge 28) of the seal wing.

Figure 3A:
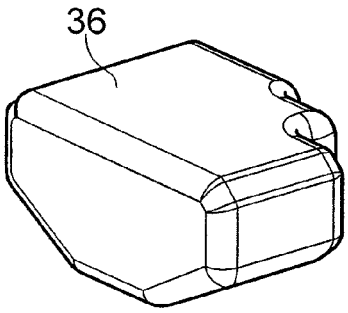
FIG. 3 depicts a perspective, plan and side view of an exemplary balance weight.
Figure 3B:
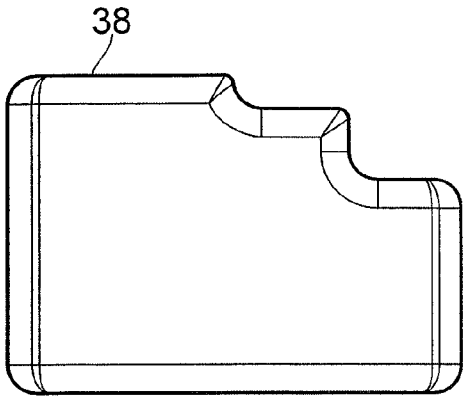
Figure 3C:
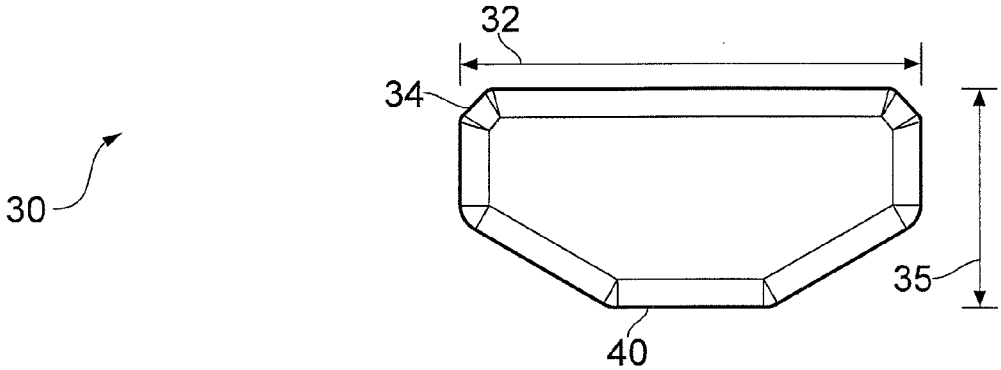

An embodiment of a balance weight 30 of the invention is depicted in FIG. 3 in perspective, FIG. 3*a*, in plan, FIG. 3*b* and in side view, FIG. 3*c*. The weight is of a size which permits loading into the slot 4 so that it can be positioned between the root blocks 16 of adjacent blades 6. The axial length 32 of the weight is sufficient to span the axial width of the slot and the weight has chamfered edges which are a point of contact between the disc and the weight such that clearance is maintained between the top 36 of the weight 30 and the underside of the seal wing 20 to ensure there is no undesired load through the seal wing. The chamfered edges 34 provide a surface contact with the disc rather than a point or edge contact to minimise damage or wear at the contact.

Figure 4:
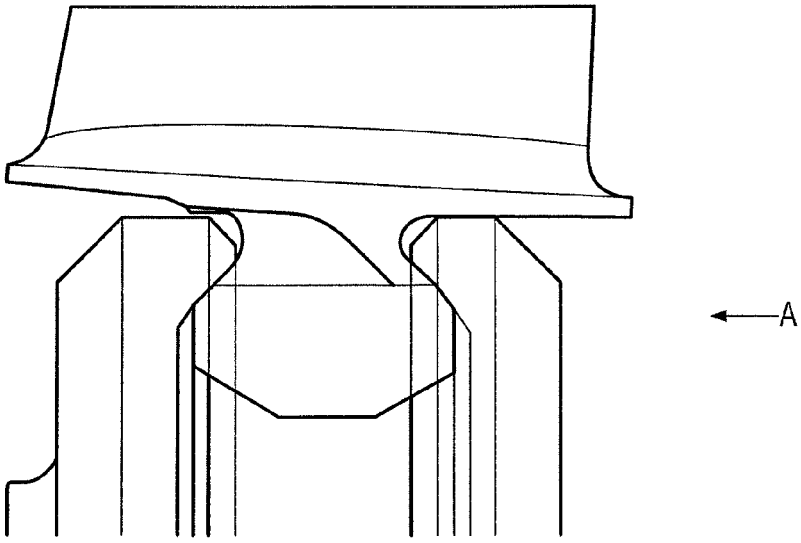
FIG. 4 depicts a side view of the balance weight and blade located in the slot.

As shown in FIG. 4, which depicts the weight in position within the slot, the weight tapers towards its bottom surface 40. to prevent undesirable clashes or interference with the disc slot and reduce the possibility of friction at this location. The weight is held away from the base of the slot in use by the centripetal force generated from the rotating disc. The weight applies loads radially outwards onto both the fore and aft disc loading flanks during engine operation.

The balance weight has a circumferential face 38 which abuts a circumferential face 18 of the root block 16 under adverse tolerance or positioning. Beneficially, this helps to constrain the circumferential position of the balance weight.

Figures 5A, 5B:
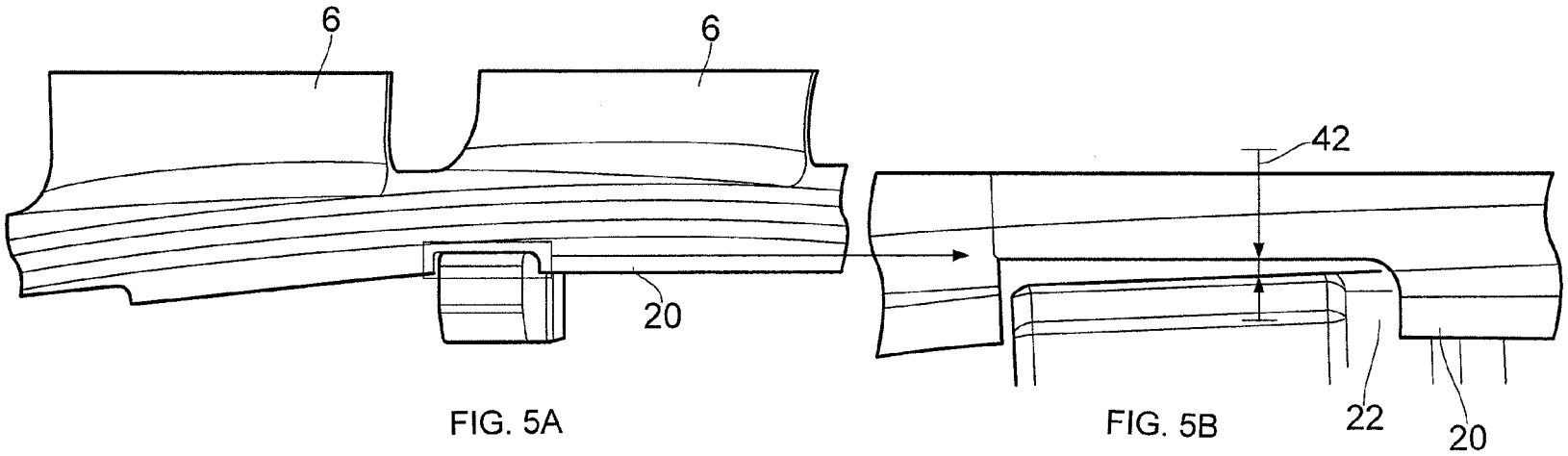
FIG. 5 depicts a view in the direction of arrow A in FIG. 4.

FIG. 5*a* is a view of the disc along arrow A in FIG. 4. FIG. 5*b* is an enlarged view of FIG. 5*a* and depicts the clearance 42 of the weight 30 from the underside of the seal wing cut-out 22 (also known as a Notch 22 or stepped end 22) and which prevents radially outward load being applied to the blade from the balance weight. The height 35 of the weight is sufficient to overlap with the blade root block to ensure, when the weight is positioned against the bottom of the disc slot when the engine is not rotating, that the weight is not able to slide under the root blocks of adjacent blades to a position which would upset the balance of the rotor.

When the shaft on which the rotor is mounted is spinning the weight is located radially by the contact faces of the disk flanks. When the shaft is not spinning there is space available below the weight for it to fall to the bottom of the disc slot. The dimensions of the insert are such that it remains in the required circumferential position so that when the shaft begins to spin again it will relocate itself in the correct radial and circumferential position.

Figure 6:
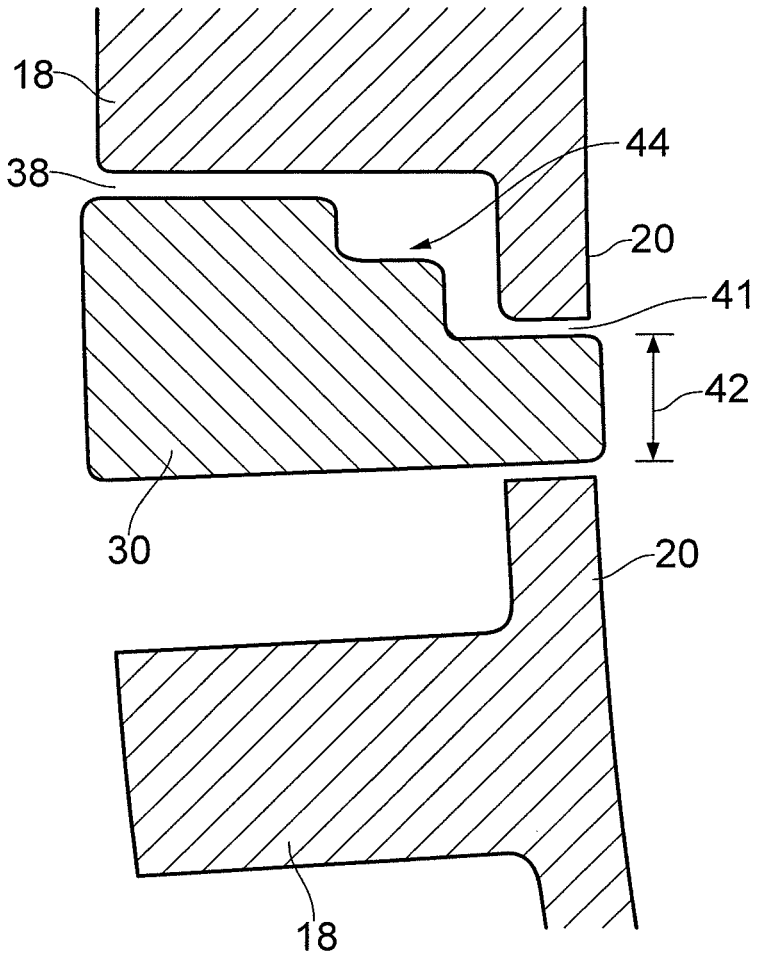
FIG. 6 is top view of the weight of FIG. 4 in position in the slot.

The weight is not locked into position but instead is circumferentially held in place by contact of one circumferential face 38 with the side face of one of the root blocks as shown in FIG. 6 and the side of the cut-out 22 (also known as a Notch 22 or stepped end 22) in the seal wing 20. The contact at the circumferential face 38 is desirable to permit any forces, either steady state or impulse, are transmitted over a relatively large area. This minimises damage to either the weight or rotor blade.

To ensure the mating surface 38 of the insert and the side of the rotor blade root block are parallel or flush, a clearance 41 is required between the side of the weight and the side of the cut-out 22 (also known as a Notch 22 or stepped end 22) of the seal wing 20. Contact at this point could result in no contact at 38, however, the dimension 42 of the weight between the seal fins can be carefully selected during manufacture such that clearance 41 is maintained and there is no load transfer to the adjacent seal fin.

The weight is coated in a dry film lubricant to reduce friction with the rotor or disc. The weights could be made from materials similar to that of the rotors e.g. titanium. However, for the balance correction to be achieved within the given volume of the insert it may be necessary to include denser material such as steel either as the whole material of the weight or as an insert coated, or alloyed in another material.

Material can be removed from or added to the weight, particularly in the region 44 or in by adjusting the taper towards the underside of the weight. The shape of the weight in the region 44 may not be stepped but instead may be curved.

Beneficially, the weight avoids mis-assembly as the geometry is such that it cannot be assembled into the disc slot upside down. Similarly, if installed back to front there will be a resulting gap between the annulus platforms of the adjacent blades which will be visible in assembly.

Figure 7A:
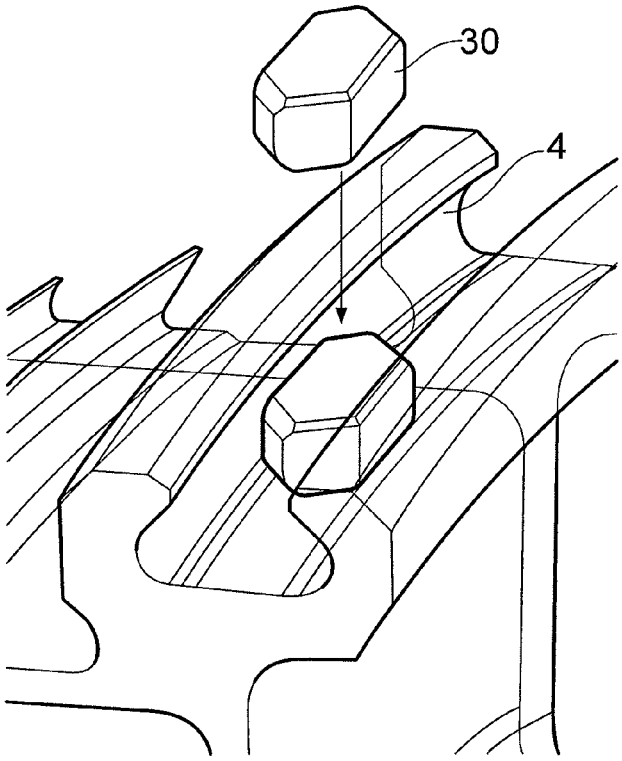
FIG. 7 depicts an alternative balance weight in accordance with the invention.
Figure 7B:
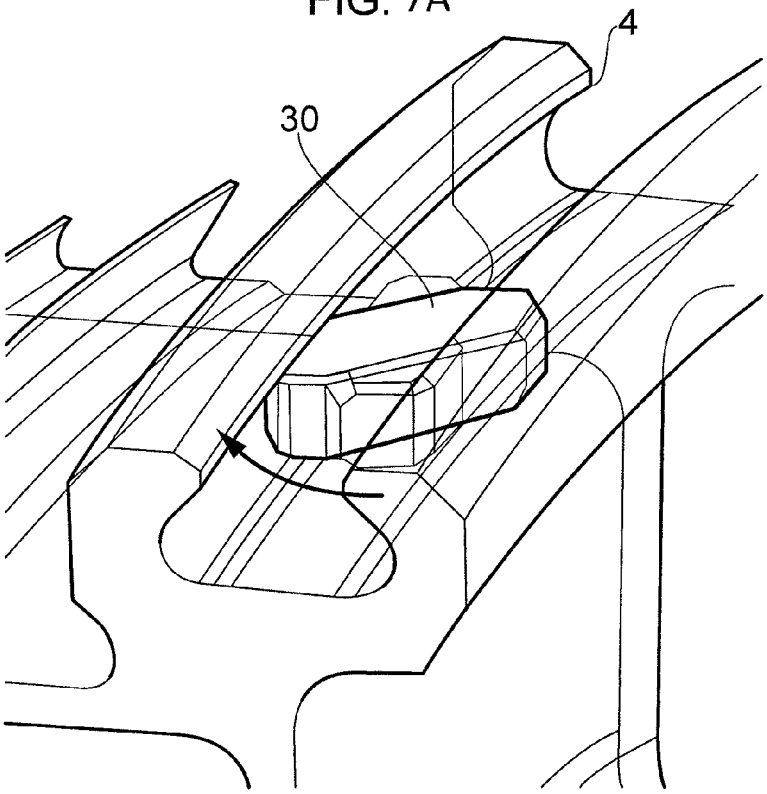

In an alternative form of the balance weight as shown in FIGS. 7*a* and 7*b*, the weight 30 is shaped such that it can be inserted between the walls of the disc slot 4 without having to be assembled through specific loading slots. The weight is of a general parallelogram form and can be rotated (FIG. 7*b*) into place and loads outwards onto the disc flanks during operation. This assembly method can prevent the need to remove a significant number of assembled blades in order to load the weight into position thus saving a significant amount of time particularly is a number of balance iterations are required.

As per the first embodiment a portion of the weight loads against the root block whilst a further portion extends into the seal fin cut-out to prevent rotation of the weight at rest.

For this embodiment the notch or cut-out of the seal fin in which the weight is engaged may extend from a circumferentially extending, or bottom, edge of the seal wing but not from a radially extending, or side, edge.

The invention claimed is:

1. A balanced rotor comprising:

a circumferential slot; and a plurality of blades, each of the plurality of blades being secured in the circumferential slot by a respective root, wherein each of the plurality of blades comprises (i) an aerofoil portion, (ii) a root portion, and (iii) a platform portion, wherein the aerofoil portion and the root portion extend in opposing directions from the platform portion, wherein the root portion comprises a root block having circumferentially facing flanks and a seal wing that extends circumferentially from one of the circumferentially facing flanks, wherein the seal wing comprises a notch engaging a balance weight positioned between adjacent root portions.

2. A balanced rotor according to claim 1, wherein the balance weight has a surface which abuts one of the circumferentially facing flanks of one of its adjacent roots.

3. A balanced rotor according to claim 2, wherein the surface abuts the circumferentially facing flank of the root block from which the seal wing extends.

4. A balanced rotor according to claim 1, wherein the seal wing has a circumferentially extending edge and a radially extending edge, the notch extending into the seal wing from the circumferentially extending edge.

5. A balanced rotor according to claim 4, wherein the notch extends from the radially extending edge.

6. A blade for use in a balanced rotor according to claim 1, the blade comprising:

an aerofoil portion;

a root portion; and a platform portion, wherein the aerofoil portion and the root portion extends in opposing directions from the platform portion, wherein the root portion comprises a root block having angled flanks for engaging with a circumferential slot in a gas turbine disc or drum and opposing circumferentially facing flanks connecting the angled flanks, wherein a seal wing projects from at least one of the opposing circumferentially facing flanks and has a notch for engaging a balance weight.

7. A blade according to claim 6, wherein the seal wing has a bottom edge and a side edge and the notch extends into the seal wing from the bottom edge.

8. A blade according to claim 7, wherein the notch extends into the seal wing from the side edge.

9. A method of assembling a rotor comprising the steps of providing a drum or disc having a circumferential slot, loading at least one blade according to claim 6 into the slot, and inserting a weight into the slot, the weight engaging the notch.

* * * * *